United States Patent [19]

Castle

[11] Patent Number: 5,069,736

[45] Date of Patent: Dec. 3, 1991

[54] METHOD OF PAIL CONSTRUCTION

[76] Inventor: Randall D. Castle, Post Office Box 204, New Hazelton, British Columbia, Canada, V0J 2J0

[21] Appl. No.: 569,479

[22] Filed: Aug. 20, 1990

[51] Int. Cl.[5] ..... B32B 31/18

[52] U.S. Cl. ..... 156/94; 156/250; 156/264; 156/293; 156/294; 220/320; 220/561

[58] Field of Search ..... 156/94, 250, 264, 293, 156/294; 220/320, 561, 904; 229/5.6

[56] References Cited

U.S. PATENT DOCUMENTS

| | | | |
|---|---|---|---|
| 3,660,188 | 5/1972 | Van Leer | 156/94 |
| 3,897,884 | 8/1975 | Lankenau | 220/320 |
| 4,344,546 | 8/1982 | Dry | 220/561 |

FOREIGN PATENT DOCUMENTS

| | | |
|---|---|---|
| 545779 | 9/1957 | Canada . |
| 819532 | 8/1969 | Canada . |
| 972696 | 8/1975 | Canada . |
| 1244784 | 11/1988 | Canada . |

*Primary Examiner*—Caleb Weston

*Attorney, Agent, or Firm*—Shlesinger, Arkwright & Garvey

[57] ABSTRACT

In a method of constructing a reinforced pail from an existing pail having a covered top, an annular ring is formed from a top portion of the side wall by removing the top cover and cutting the side wall around a periphery parallel to the top end of the existing pail, thereby forming a modified pail. The annular ring is then slid as a concentric sleeve over the modified pail to a position where it snugly engages and reinforces the modified pail. The ring is then secured to the pail in such position.

6 Claims, 3 Drawing Sheets

METHOD OF PAIL CONSTRUCTION

FIELD OF THE INVENTION

This invention relates to methods of pail construction and, in particular, to a method of constructing a reinforced general purpose utility pail from another design of pail having a more restricted purpose.

BACKGROUND TO THE INVENTION

Moderately sized pails having secured top covers, and that are used for the purpose of containing oil or other liquids, are in widespread use in North America. Typical examples would include 5 gallon and 20 liter molded plastic pails used to hold motor oil. Very often the covers of these pails cannot be easily removed. Limited access is normally provided by a capped spout positioned in the cover.

Once the oil has been drained from such a pail, the usefulness of the pail in its existing form is limited. The top cover of the pail precludes easy access to the interior, either for the purpose of cleaning the pail or for the purpose of refilling and carrying some fresh oil or other liquid. Such a pail is obviously unsuited as a general purpose utility pail for carrying liquids or solids, and a great many are simply thrown away.

A primary object of the present invention is to provide a method of constructing a general purpose utility pail having a durable reinforced structure from a limited purpose pail having a secured top cover.

A further object of the present invention is to modify existing pails having limited utility in a way that encourages continuing use while minimizing waste, thereby reducing consequential environmental impact that occurs when the existing pails are thrown away in their entirety.

SUMMARY OF THE INVENTION

In accordance with a broad aspect of the present invention, there is provided a method of constructing a reinforced pail from an existing pail having a top end, a cover secured over the top end, a closed bottom end, and a cylindrical side wall tapering outwardly between the bottom end and the top end. The method comprises the step of forming an annular ring from a top portion of the side wall by removing the top cover and cutting the side wall around a lower periphery parallel to and spaced below the top end, thereby forming a modified pail having an open top end at the height of the lower periphery. Then, the ring is slid as a concentric sleeve over the modified pail to a position where it snugly engages the modified pail. In this position, the ring is then secured to the modified pail (by using glue or other suitable means) where it serves to reinforce the pail.

In one embodiment of the present invention, the annular ring is formed by cutting the side wall not only around the lower periphery noted above but also around an upper periphery above the lower periphery and parallel to and just below the top end of the pail (thereby removing the top cover). This approach may be preferred where the top cover is otherwise difficult or time consuming to remove.

In a preferred embodiment of the present invention, the existing pail before modification includes a bail coupled to the pail on opposed sides of the side wall, and this bail is retained with the annular ring for the reinforced pail.

Of course, it will be obvious that a pail having a secured top cover may be converted into a general purpose utility pail by merely removing the cover. However, merely removing the cover can produce an undesirable weakening in the structure of the pail. Typically, to conserve material, pails of the 20 liter or 5 gallon size will be made from a relatively flexible, thin-walled plastic, relying upon the top itself to provide some mechanical support. By cutting an annular ring from the side wall of the original pail, and positioning the ring in the manner indicated above, the rigidity and strength of the upper portion of the pail is reinforced. The overall volume of the pail is necessarily reduced. However, the smaller size will be easier to handle, and this will provide added encouragement to make use of the pail and not throw it away.

The invention is considered most preferable for use in connection with pails formed from flexible plastic material. These kinds of pails stand to benefit most from the reinforcement provision, and it is these kinds of pails which are creating a notable disposal problem and environmental threat.

The invention will now be described in more detail with reference to the drawings.

DETAILED DESCRIPTION

Figure 1:
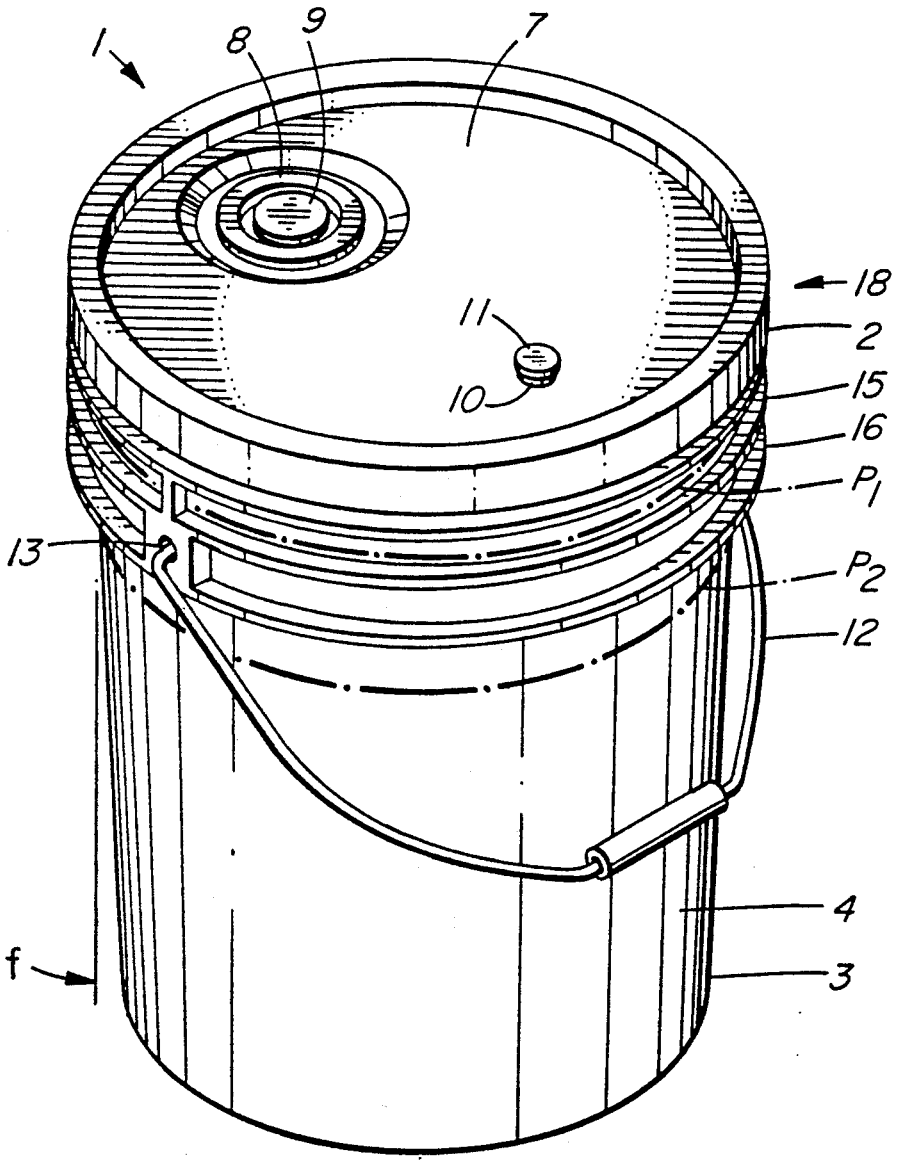
FIG. 1 PRIOR ART
FIG. 1 is a perspective view of a prior art pail used in the method of the present invention.

FIG. 1 illustrates a typical prior art design for a 20 liter molded plastic pail, generally designated 1, that is used to hold motor oil (not shown). Pail 1 includes a top end 2, a closed bottom end 3, and a cylindrical side wall 4 that has a slight flare or outward angle of taper "f" from bottom to top.

Pail 1 includes a cover 7 secured over top end 2 in a manner difficult to remove. A spout 8 (with a removable cap 9) and a breathing hole 10 (with a removable cap 11) are positioned in cover 7 to permit and facilitate the pouring of liquid from the pail.

It will also be observed that pail 1 includes a bail 12 coupled to the pail at 13 on diametrically opposed sides of side wall 4 between a pair of structural ribs 15, 16. However, while such elements are present in this case, and while it is considered desirable to retain such elements as part of the final pail construction to be described below, they are not considered essential. (In the Figures, the coupling at 13 is shown on only one side of the pail.)

Once oil has been drained from pail 1, its utility in its existing form is limited because cover 7 impedes access, either for the purpose of cleaning the pail or refilling the pail. The only access would be through spout 8 or breathing hole 10. While this might be acceptable for a limited number of situations, these situations are few compared to the general utility that will exist if cover 7 is removed.

Figure 2:
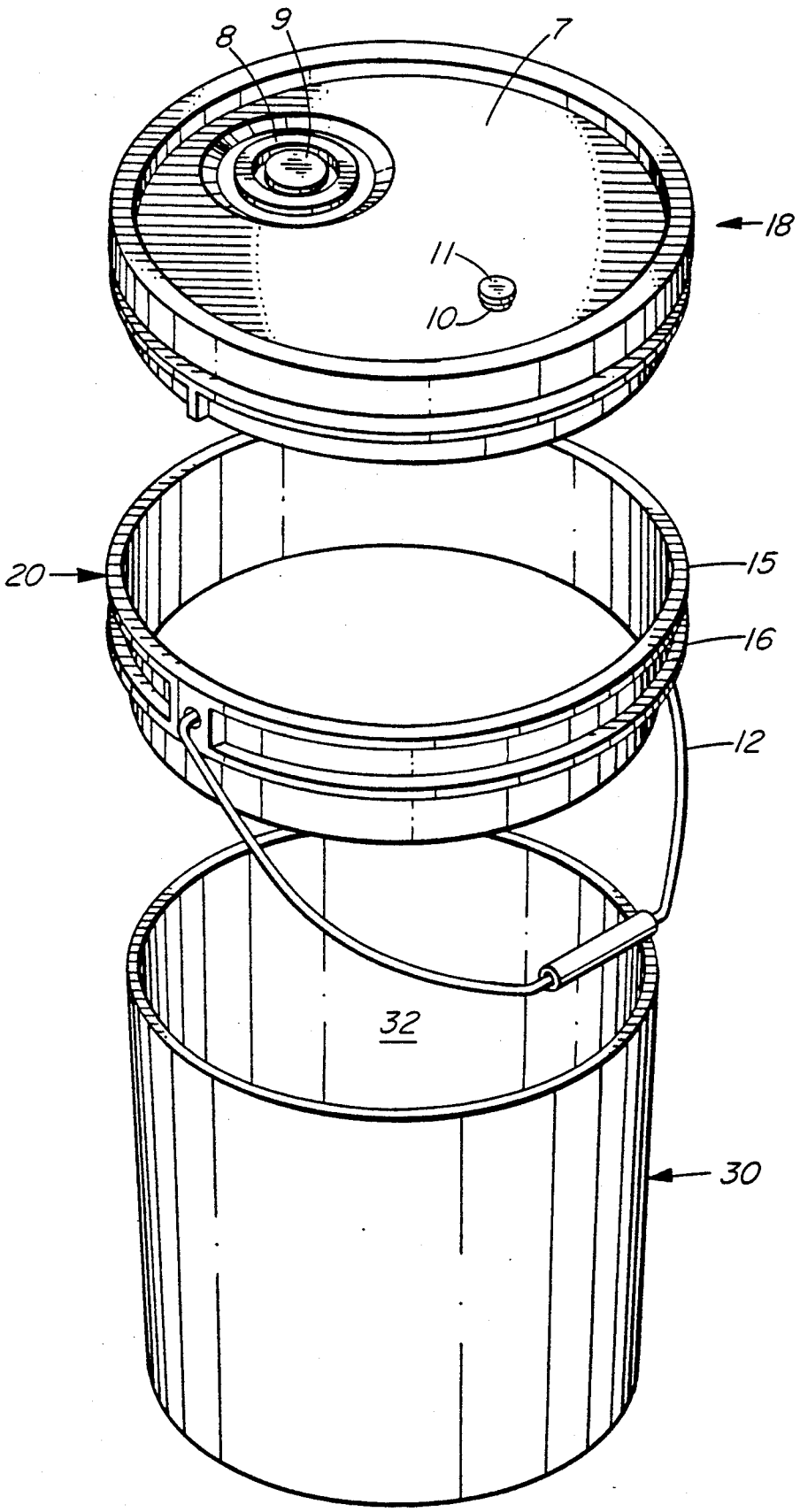
FIG. 2 is an exploded perspective view of the pail in FIG. 1 when cut along $P_1$ and $P_2$ in FIG. 1 and separated into three parts: a top part, an annular ring, and a modified pail.

To convert pail 1 to a reinforced general purpose utility pail, the first step is to cut side wall 4 around upper and lower peripheral lines $P_1$ and $P_2$ shown in phantom outline in FIG. 1. When these cuts are made, pail 1 separates into three parts as shown in FIG. 2—a top part generally designated 18 which includes cover 7 and a small portion of side wall 4; an annular ring 20; and a modified pail generally designated 30 having an open top 32. As will be noted, cut line $P_1$ is above rib 15 and cut line $P_2$ is below rib 16 such that the ribs and bail 12 are retained with ring 20.

Figure 3:
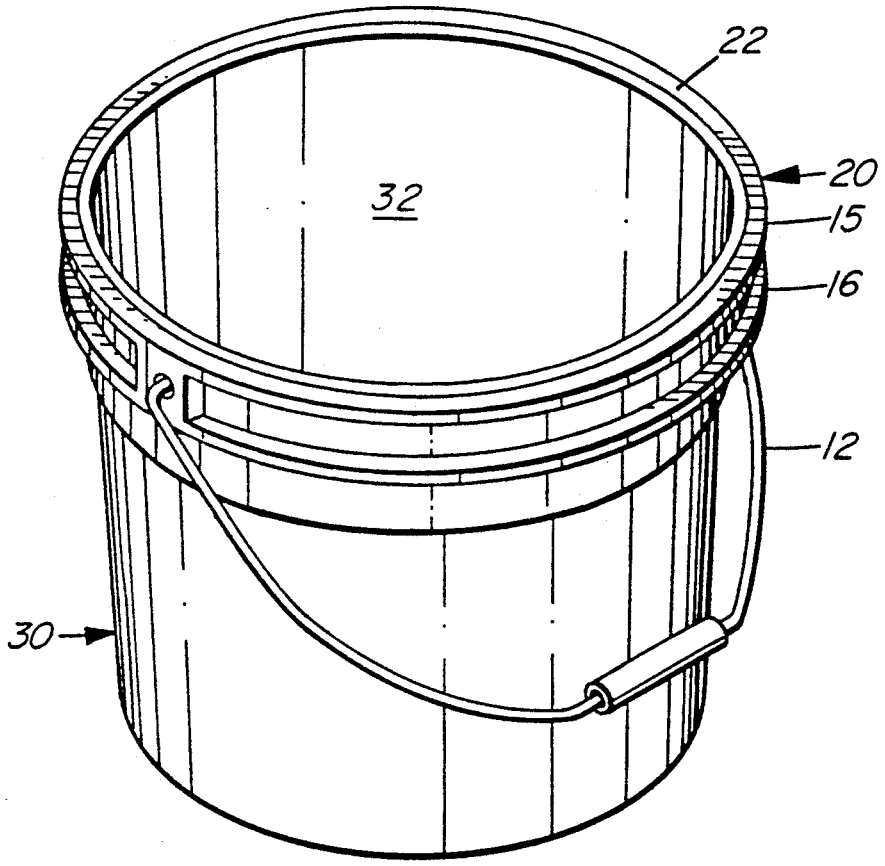
FIG. 3 is a perspective view of the modified pail in FIG. 2 with the ring shown in FIG. 2 positioned as a reinforcing sleeve over the modified pail.

Then, ring 20 is slid as a concentric sleeve over pail 30 to a position where it snugly engages and reinforces the side wall of pail 30 as shown in FIG. 3. The ring is secured in this position, preferably using glue such as fiberglass or polyester resin.

This leaves top part 18 shown in FIG. 2 as a throw-away item. However, the amount of waste represented by this part is substantially less than would be represented by pail 1 as a whole.

The order in which cuts are made along line $P_1$ and line $P_2$ is not considered crucial. Generally, however, it has been found convenient to make the first cut along line $P_1$ thereby separating the top part 18.

In FIG. 3, it will be noted that top 22 of reinforcing ring 20 lies flush with open top 32 of pail 30. This positioning is not considered crucial, and it will be appreciated that the positioning of the ring anywhere as a sleeve over pail 30 will perform a reinforcing function. However, the flush position, or a position near the top of the pail 30, is considered desirable because the top of the pail is structurally the weakest or most flexible part without added support. Further when the pail includes a bail as it does in the present case, then it is clearly desirable that the bail be coupled near the top.

The result of the foregoing procedure, as illustrated in FIG. 3, is a general purpose utility pail 30, the structure of which is reinforced by ring 20. The handy feature of bail 12 from original pail 1 has been retained, as have structural ribs 15, 16.

A number of observations may be made at this stage. These should be largely self-evident to those skilled in the art, but some comment is nevertheless considered desirable.

The vertical height of reinforcing ring 20 on pail 30 is a function of various factors including the height "H" of the original pail at cut line $P_1$, the thickness "t" and flexibility of side wall 4, the width "W" of ring 20, and the flare angle "f".

If the pail had no flare whatsoever, and unless the diameter of ring 20 could be significantly stretched, then the ring obviously would not fit over the pail. The wall thickness of ring 20 would simply abut the wall thickness of pail 30. Such abutment would also occur if, generally, the overall flare between top and bottom was slight and not sufficient to overcome wall thickness.

With simplifying assumptions, it is possible to develop relatively basic criteria specifying geometric relationships that exist, or that should be met in order to achieve an end result as illustrated in FIG. 3. For example, if it is assumed that the material construction of the pail is inflexible, then the condition $t<H \sin(f)$ should be satisfied in order for ring 20 to slide as a sleeve over the pail. Likewise, assuming that the flare angle is uniform from top to bottom as it is presumed to be in the embodiment shown in the Figures, and again assuming inflexibility in the material construction, then top 22 of ring 20 can be moved to a position flush with top 32 of pail 30 and no further if $W=t/\sin(f)$.

Despite the foregoing, it has not been found necessary in practice to measure angles or wall thickness accurately or at all. Indeed for cases where the material construction of the pail is flexible, it should normally be found more practical and more expedient to rely on trial and error to determine a suitable width W for reinforcing ring 20.

Mathematical precision is unlikely to matter in any critical way because in most pratical cases flexibility will avoid any requirement for fine measurements or close tolerances. If a ring does not naturally fit quite as high as the user might prefer, then it can usually be forced a bit higher.

To place some further perspective on the matter, it may be noted that a typical 20 liter pail as represented by FIG. 1 had a diameter slightly over 10 inches at its base, and stood slightly over 15 inches in height. The wall thickness was ⅛ inch. In the converted form shown in FIG. 3, the height of pail 30 was about 10½ inches. The width of reinforcing ring 20 (top to bottom) was about 2½ inches. According to the above formula $W=t/\sin(f)$, this would indicate an overall flare angle of about 3°. (This angle was never measured, and no determination was made that the actual degree of flare was uniform from bottom to top.)

In the embodiment that has been described, annular ring 20 was formed by making an upper peripheral cut $P_1$ and a lower peripheral cut $P_2$, the reason being that cover 7 was difficult to remove. Assuming however that cover 7 could be removed, albeit with difficulty, an annular ring could then be formed with only a lower peripheral cut. If the top end of the pail included an inward flange, then the annular ring may include the flange. Assuming that the pail has sufficient flexibility, the annular ring with the flange can be cut to slide over the modified pail to a position where the flange just overlies the top end of the pail where the ring is then secured in position.

Various modifications to the invention as described in relation to the foregoing embodiment are possible within the spirit and scope of the following claims.

I claim:

1. A method of constructing a reinforced pail from an existing pail having a top end, a cover secured over said top end, a closed bottom end, and a cylindrical side wall tapering outwardly between said bottom end and said top end, said method comprising the steps of:

(a) forming an annular ring from a top portion of said side wall by removing said top cover and cutting said side wall around a lower periphery parallel to and spaced below said top end, thereby forming a modified pail having an open top end at the height of said lower periphery;

(b) sliding said ring as a concentric sleeve over said modified pail to a position where said ring snugly engages and reinforces said modified pail; and, (c) securing said ring to said modified pail in said position.

2. A method as described in claim 1, wherein said annular ring is formed by cutting said side wall around an upper periphery parallel to and just below the top end of said existing pail thereby removing said cover, said lower periphery being spaced below said upper periphery.

3. A method as described in claim 1, wherein said existing pail includes a bail coupled to the existing pail on diametrically opposed sides of said side wall, said lower peripheral cut being made below the level of said coupling such that said bail is coupled to said ring after said cuts are made.

4. A method as described in claim 1, wherein said ring is slid to a position where the top of said ring is flush with said open top of said modified pail.

5. A method as described in claim 2, wherein said existing pail includes a bail coupled to the existing pail on diametrically opposed sides of said side wall, said lower peripheral cut being made below the level of said coupling and said upper peripheral cut being made above the level of said coupling such that said bail is coupled to said ring after said cuts are made.

6. A method as described in claim 1, 2, 3, 4 or 5, wherein said existing pail is formed from a flexible plastic material.

* * * * *